United States Patent [19]

Helgesson

[11] Patent Number: 4,926,725

[45] Date of Patent: May 22, 1990

[54] DEVICE FOR ALIGNING AND CUTTING A WEB

[75] Inventor: Bernt Helgesson, Sandhult, Sweden

[73] Assignee: Akab of Sweden AB, Sweden

[21] Appl. No.: 259,051

[22] Filed: Oct. 18, 1988

[51] Int. Cl.[5] ..... D06H 7/02; B26D 7/14

[52] U.S. Cl. ..... 83/155; 83/175; 83/251; 83/277; 83/468.6

[58] Field of Search ..... 83/155, 175, 18, 42, 83/251, 277, 206, 262, 282, 418, 421, 391, 392, 466, 467 R, 467 A, 468.6

[56] References Cited

U.S. PATENT DOCUMENTS

| | | | |
|---|---|---|---|
| 3,318,179 | 5/1967 | Elsas | 83/249 |
| 4,034,634 | 7/1977 | Arbter | 83/18 |
| 4,586,411 | 5/1986 | Koivula | 83/175 |
| 4,781,087 | 11/1988 | Shibata | 83/18 |

FOREIGN PATENT DOCUMENTS

| | | |
|---|---|---|
| 3225375 | 1/1984 | Fed. Rep. of Germany . |
| 3024389 | 9/1985 | Fed. Rep. of Germany . |
| 3431210 | 2/1986 | Fed. Rep. of Germany . |
| 86/00349 | 1/1986 | PCT Int'l Appl. . |
| 2147237 | 5/1985 | United Kingdom . |

*Primary Examiner*—Douglas D. Watts
*Assistant Examiner*—Eugenia A. Jones
*Attorney, Agent, or Firm*—Ostrolenk, Faber, Gerb & Soffen

[57] ABSTRACT

A device for aligning and cutting a web having a thickness which varies in the longitudinal direction, e.g. a terry cloth with piled portions alternating with pile-free portions. The device comprises a pair of rulers extending across the web and which rulers are adjustable with respect to each other so that either the web can pass freely therebetween or only pile-free portions thereof, seizing- and transferring structure arranged in front of the rulers as seen in the feeding direction of the web and arranged to bring along a piece of cloth from the web and transfer this to a conveyor device and a pulling device for pulling out a desired length of the piece of cloth. For allowing webs of different widths to pass between the aligning rulers these are displaced with respect to each other in the longitudinal direction so that the hemmed longitudinal edges of the pieces of cloth are located outside one end edge of the respective ruler, and that the relative position of the rulers is adjustable to fit pieces of cloth of different widths.

7 Claims, 4 Drawing Sheets

DEVICE FOR ALIGNING AND CUTTING A WEB

TECHNICAL FIELD

The present invention refers to a device for aligning and cutting a web having a thickness which varies in the longitudinal direction, e.g. a terry cloth with piled portions alternating with pile-free portions, and which device comprises aligning means in the form of a pair of rulers extending across the web and which rulers are adjustable with respect to each other so that either the web can pass freely therebetween or only pile-free portions thereof, seizing- and transferring means arranged in front of the aligning means as seen in the feeding direction of the web and arranged to bring along a piece of cloth from the web and transfer this to a conveyor device and a pulling device for pulling out a desired length of the piece of cloth.

BACKGROUND OF THE INVENTION

A device of this kind for straight cutting in the thread direction of a terry cloth web and where the pile-free sections of the web are utilized for aligning the web is shown in SE-B-437.605 (corresponding to US-A-4,586,411). In order to allow the hemmed longitudinal edges of the web to pass between the alignment rulers at least one of said rulers is provided with recesses. When webs of several different widths occur the alignment rulers must have several such recesses. There is however a certain limitation of the freedom of choice concerning the width of the web with this device.

OBJECT AND MOST IMPORTANT FEATURES OF THE INVENTION

The object of the invention is to provide a device of the kind mentioned above, which in a simple way gives an increased freedom of choice concerning the width of the web. This has been provided by the fact that said rulers are displaced with respect to each other in the longitudinal direction so that the hemmed longitudinal edges of the piece of cloth are located outside one end edge of the respective ruler, and that the relative position of the rulers is adjustable to fit pieces of cloth of different widths.

DESCRIPTION OF THE DRAWINGS

The invention will now be described more in detail with reference to an embodiment shown in the accompanying drawings.

DESCRIPTION OF THE INVENTION

Figure 1:
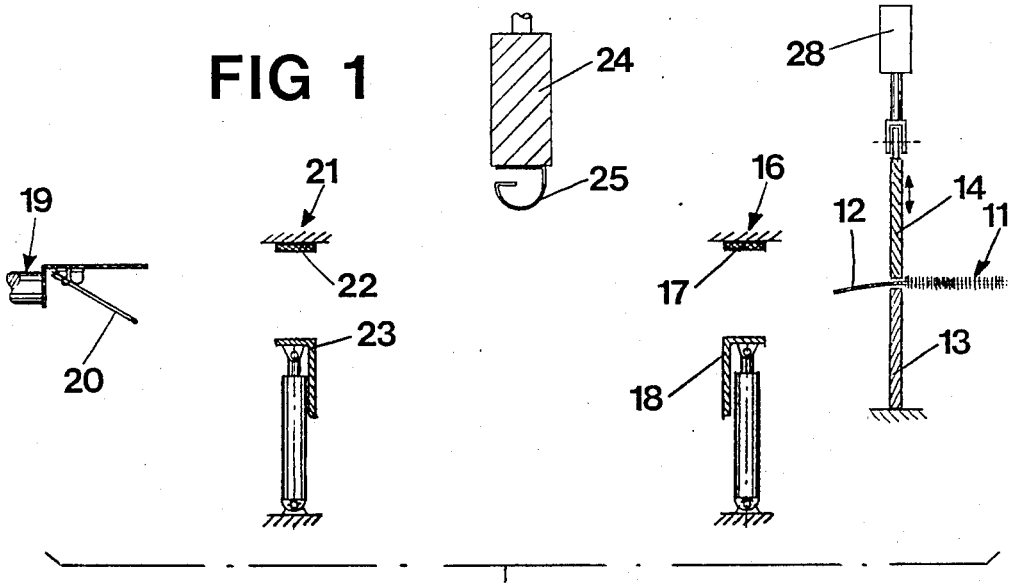
FIGS. 1–5 show schematic side views of the device in five different stages of operation.

The device comprises a feed table (now shown) on which a web 11 is fed from a supply roll (not shown ). The web consists of e.g. a terry cloth web provided with pile-free sections 12 extending across the longitudinal direction of the web 11. The pile-free sections 12 consist of the bottom fabric of the web. On one end of the feed table there is arranged two straight-edge rulers 13 and 14, one of which is fixed while the other 14 is movable towards and away from the fixed ruler 13 by means of a suitable driving means 28. The rulers 13, 14 can in vertical direction be adjusted in two positions with respect to each other, one position in which the web can pass freely between the rulers and another position in which only pile-free sections 12 of the web can pass. The rulers 13, 14 are in their longitudinal direction displaceable relative to each other, so that the hemmed longitudinal edges 15 of the web are allowed to pass outside one of the end edges 13*a* and 14*a* of the respective ruler. The relative position of the rulers 13, 14 is adjustable for adaptation to webs 11 of different widths.

In front of the straight-edge rulers 13, 14 as seen in the feed direction of the web 11 and at a distance from this, there is arranged a first conveyor device 16 in the form of a conveyor belt 17. This is arranged to cooperate with a pressure plate 18, which by means of a suitable driving means is displaceable from a passive position below the web 11 to active position (FIG. 5), in which it presses the web 11 to engagement against the conveyor belt 17. With the pressure plate 18 in the passive position a space is formed between this and the conveyor belt 17, through which a seizing means 19 of a transfer device 20 is insertable. A second conveyor device 21 comprising a conveyor belt 22 and a pressure plate 23 is arranged just in front of the first conveyor device 16 at a certain distance from this. The seizing means 19 also pass through the second conveyor device 21 when the pressure plate 23 is in its passive position.

A pulling device comprising a bar 24 extending across the web is arranged between the two conveyor devices 16 and 21. The bar 24 is by means of a driving means movable towards and away from the web 11 and has on its underside facing the web a plurality of spring members 25, which are arranged to spring in the feeding direction of the web.

In the space between the straight-edge rulers 13, 14 and the first conveyor device 16 there can be inserted a cutting device 26, which runs on guides (not shown) arranged thus that the web 11 is cut off a distance in front of the rulers 13 and 14. A sensor 27 which senses the web and gives an impulse when a pile-free section 12 passes the sensor 27 is also arranged in front of the straight-edge rulers 13 and 14.

Figure 2:
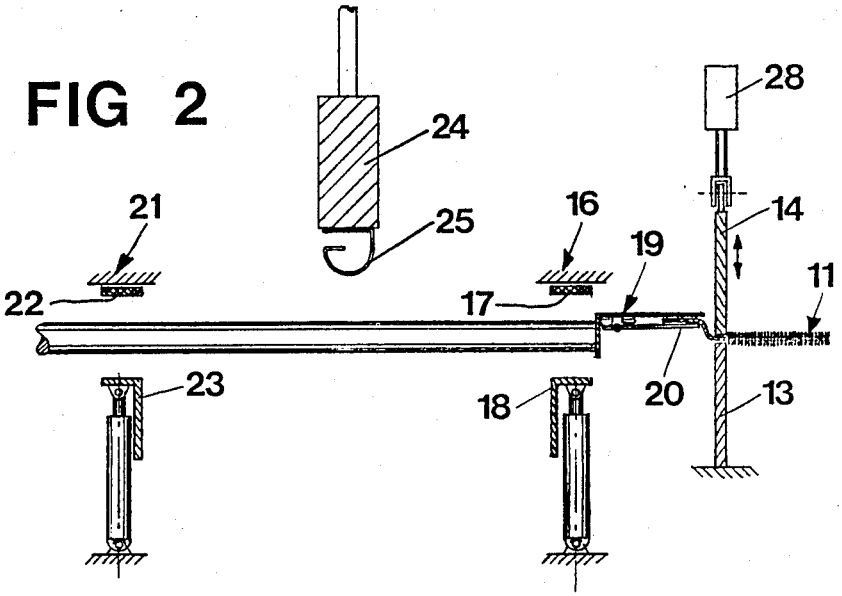
Figure 3:
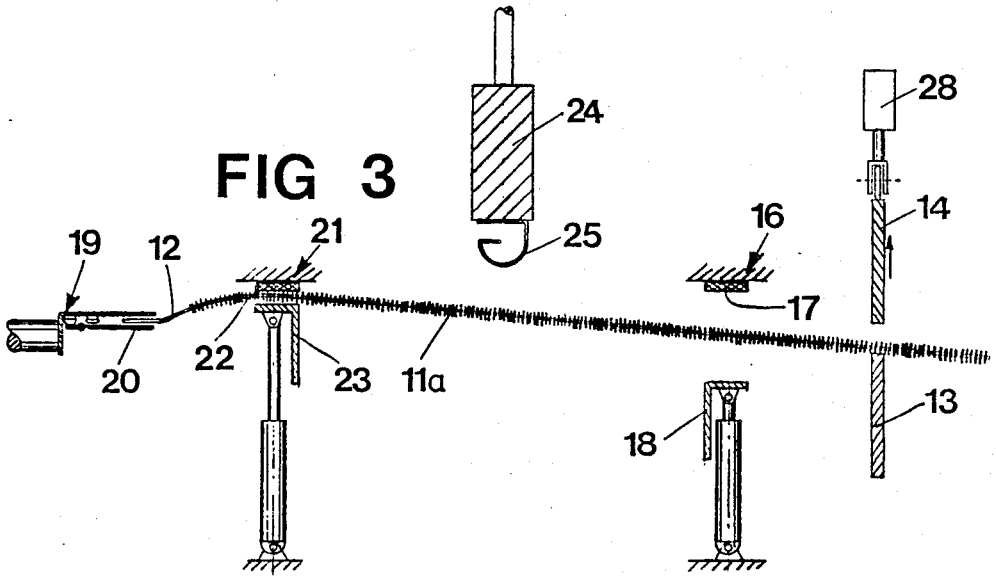

The device works in the following way. The web 11 is placed in its starting position as shown in FIG. 1 with a pile-free portion 12 located between the straight-edge rulers 13 and 14. The seizing means 20 of the transfer device is then activated and is displaced between the conveyor devices 16 and 21 towards the web 11 and seizes the front edge thereof, as is shown in FIG. 2. The movable ruler 14 is displaced from the fixed ruler 13 (FIG. 3) and the seizing means 20 is displaced backwards to its starting position and pulls the web 11 along, so that the front end portion thereof will be located in the space between the second conveyor belt 22 and the pressure plate 23, which presses the web 11 to engagement against the conveyor belt.

Figure 4:
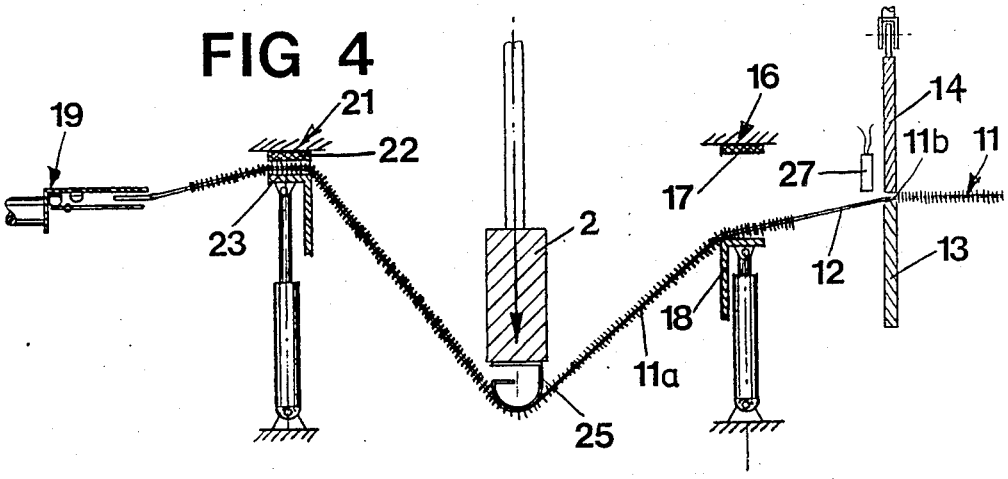
Figure 5:
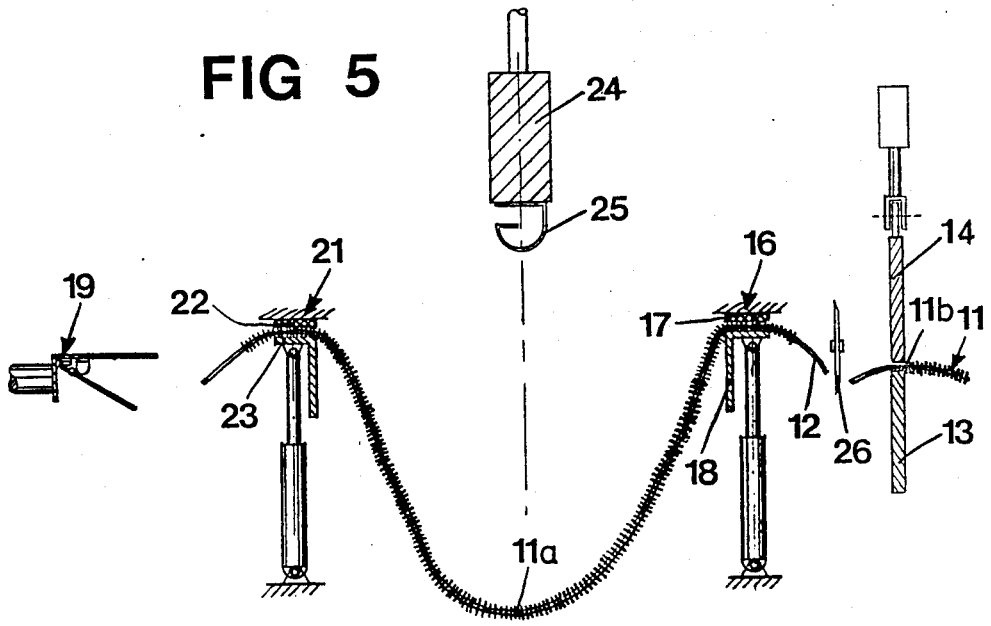
Figure 7:
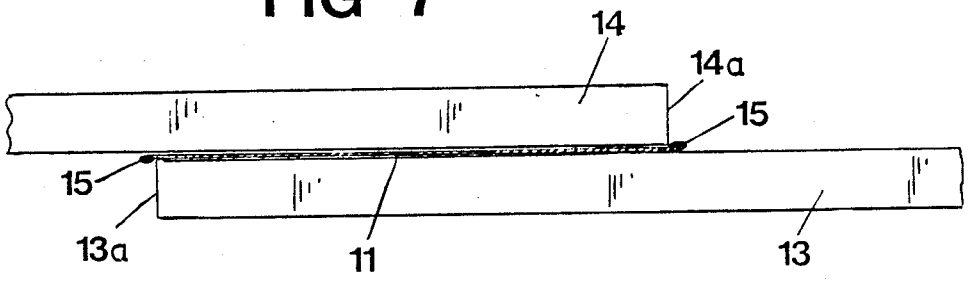
FIG. 7 is a section according to the line VII—VII in FIG. 6.
Figure 6:
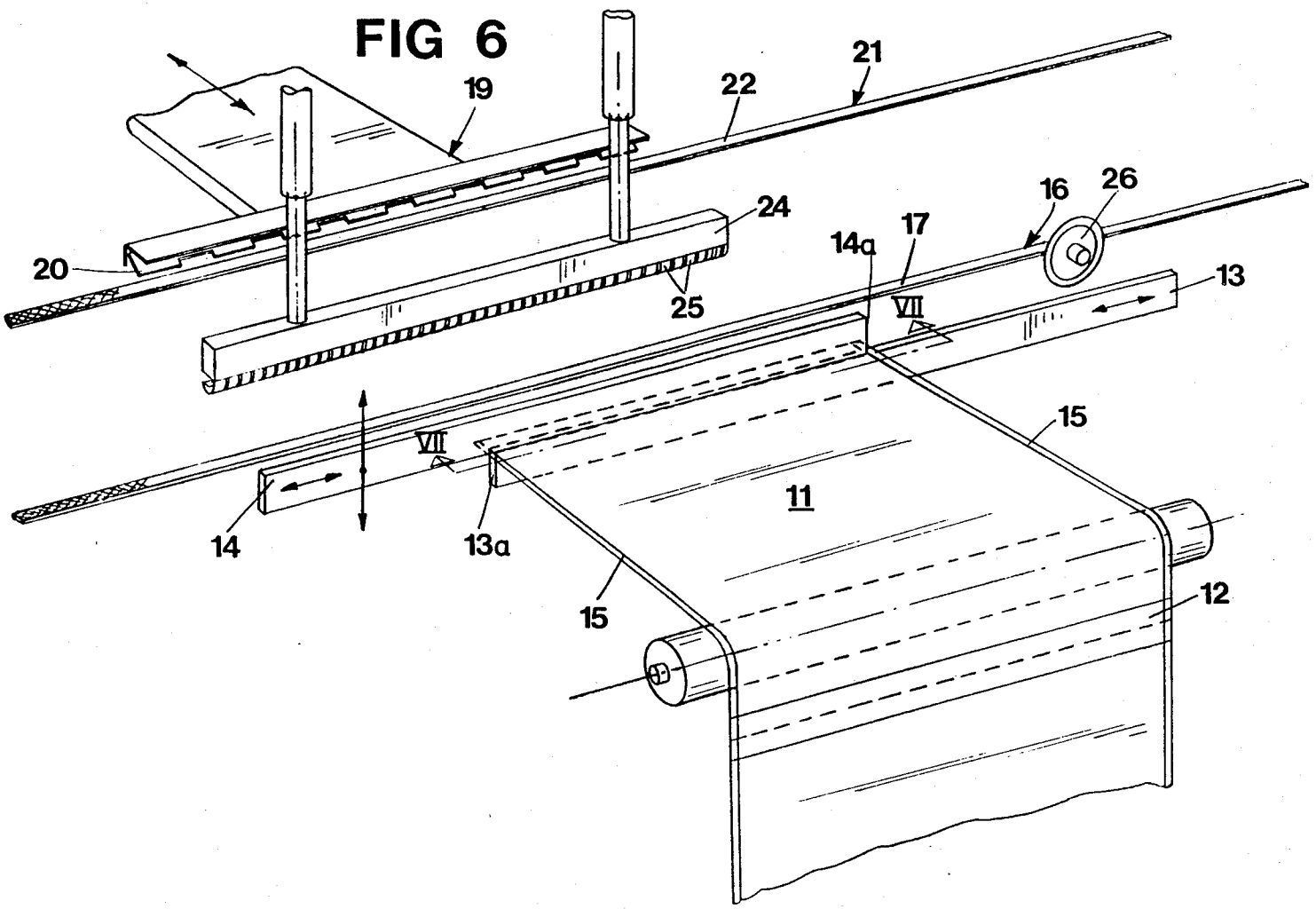
FIG. 6 shows the device in a perspective view.

After that the bar 24 is activated and presses the piece of cloth 11*a* located between the two conveyor devices 16 and 21 downwards (FIG. 4) while simultaneously pulling the web 11 forwards between the rulers 13, 14 until a pile-free section 12 will be located just opposite the sensor 27. In this position the ruler 14 is activated so that it is displaced towards the fixed ruler 13, at which only such a small slot remains, that only the pile-free section 12 can pass through the slot. The bar 24 continues to press against the mid portion of the piece of cloth 11*a*, so that the pile edge 11*b* located behind the rulers 13, 14 will be pulled against the rulers 13, 14. By the fact that the bar 24 on its underside has spring means 25, which can spring away in the feeding direction of the web 11, portions of the web 11 can pass past the bar 24, so that the web will be aligned. The bar 24 is then moved away from the web 11 to passive position (FIG. 5).

In this aligned position the web 12 will be fixedly located against the first transport belt 17 by means of the pressure plate 18. The cutting device 26 then passes along the web 11 and cuts it in the pile-free section between the aligning means 13, 14 and the first conveyor device 16 (FIG. 5).

With the piece of cloth 11*a* severed from the web the conveyor belts 17 and 22 of the conveyor devices 16 and 21 are started, so that both cut edges of the piece of cloth 11*a* are fed perpendicularly to the feeding direction of the web 11 to a hem folding- and sewing machine each for hemming of the transverse edges of the piece of cloth.

The invention is of course not limited to the embodiment shown but a plurality of variations are possible within the scope of the claims.

I claim:

1. A system for handling a web which has longitudinal edges and alternating thick portions and thin portions, said system comprising:

first and second rulers for aligning the web with respect to a direction of travel of the web through said system, said rulers being elongated in a transverse direction which is substantially perpendicular to the direction of travel of the web through said system, said rulers being adjustably spaced apart so as to selectively (1) permit the thick portions and the thin portions of the web to pass between said rulers and (2) prevent the thick portions from passing between said rulers while permitting the thin portions to pass between said rulers, said rulers overlapping each other in the transverse direction so as to permit the longitudinal edges of the web to travel through said system without having to pass between said rulers, the extent to which said rulers overlap each other in the transverse direction being adjustable so that said system can handle webs of different widths;

means for seizing a portion of the web and for transferring the web to a conveyor; and a pulling device for pulling the web in the direction of travel.

2. The system of claim 1, further comprising means for cutting the web in the vicinity of said rulers.

3. The system of claim 2, wherein said first ruler has an end which is located directly above said second ruler, said second ruler having an end which is located directly below said first ruler.

4. The system of claim 3, wherein said rulers include straight edges which are longer than the extent to which said rulers overlap each other.

5. The system of claim 2, wherein said pulling device includes a bar which is elongated in the transverse direction, said bar being movable in a vertical direction to pull the web.

6. The system of claim 5, wherein said bar includes springs for resiliently cooperating with the web.

7. A system for handling a web which is formed of terry cloth, the web having hemmed longitudinal edges and alternating thick piled portions and then pile-free portions, said system comprising:

first and second rulers for aligning the web with respect to a direction of travel of the web through said system, said rulers being elongated in a transverse direction which is substantially perpendicular to the direction of travel of the web through said system, said rulers being adjustably spaced apart so as to selectively (1) permit the thick portions and the thin portions of the web to pass between said rulers and (2) prevent the thick portions from passing between said rulers while permitting the thin portions to pass between said rulers, said rulers overlapping each other in the transverse direction so as to permit the longitudinal edges of the web to travel through said system without having to pass between said rulers, the extent to which said rulers overlap each other in the transverse direction being adjustable so that said system can handle webs of different widths;

means for seizing a portion of the web and for transferring the web to a conveyor;

a pulling device for pulling the web in the direction of travel; and means for cutting the web in the vicinity of said rulers.

* * * * *